United States Patent [19]

Higgins

[11] 4,130,678

[45] Dec. 19, 1978

[54] COLLAPSIBLE ARTIFICIAL CHRISTMAS TREE

[76] Inventor: James R. Higgins, 9516 Ferry Harbour Ct., Alexandria, Va. 22309

[21] Appl. No.: 734,555

[22] Filed: Oct. 21, 1976

[51] Int. Cl.[2] ..... A47G 33/06

[52] U.S. Cl. ..... 428/9; 150/52 R; 206/423; 248/461; 428/20; 428/35

[58] Field of Search ..... 428/7-10, 428/12, 15, 17-20, 35; 190/1; 206/423; 248/27.8, 461; 211/196, 205; 240/10 T, 10 Q; 150/52 R; 156/61; 362/122, 123

[56] References Cited

U.S. PATENT DOCUMENTS

| | | | |
|---|---|---|---|
| D. 107,668 | 12/1937 | Wadsworth et al. | 428/18 X |
| 1,694,974 | 12/1928 | Glover | 428/8 |
| 2,481,264 | 9/1949 | Tulowiecki | 248/461 |
| 3,083,824 | 4/1963 | Ness | 206/423 |
| 3,676,275 | 7/1972 | Sloane | 428/19 X |
| 3,677,867 | 7/1972 | Westlund | 428/20 X |
| 3,846,213 | 11/1974 | Thiemann | 428/18 X |
| 3,967,019 | 7/1976 | Magee | 428/19 |
| 4,020,201 | 4/1977 | Miller | 428/20 X |

*Primary Examiner*—Henry F. Epstein
*Attorney, Agent, or Firm*—Brady, O'Boyle & Gates

[57] ABSTRACT

A collapsible artificial Christmas tree having a telescopic mast mounted on a base, garland extending between the base and the top of the mast to form a generally conically-shaped configuration when in the erected position, the base being foldable to form a carrying case for storing the mast and associated garland when in the collapsed position.

9 Claims, 10 Drawing Figures

FIG. 1
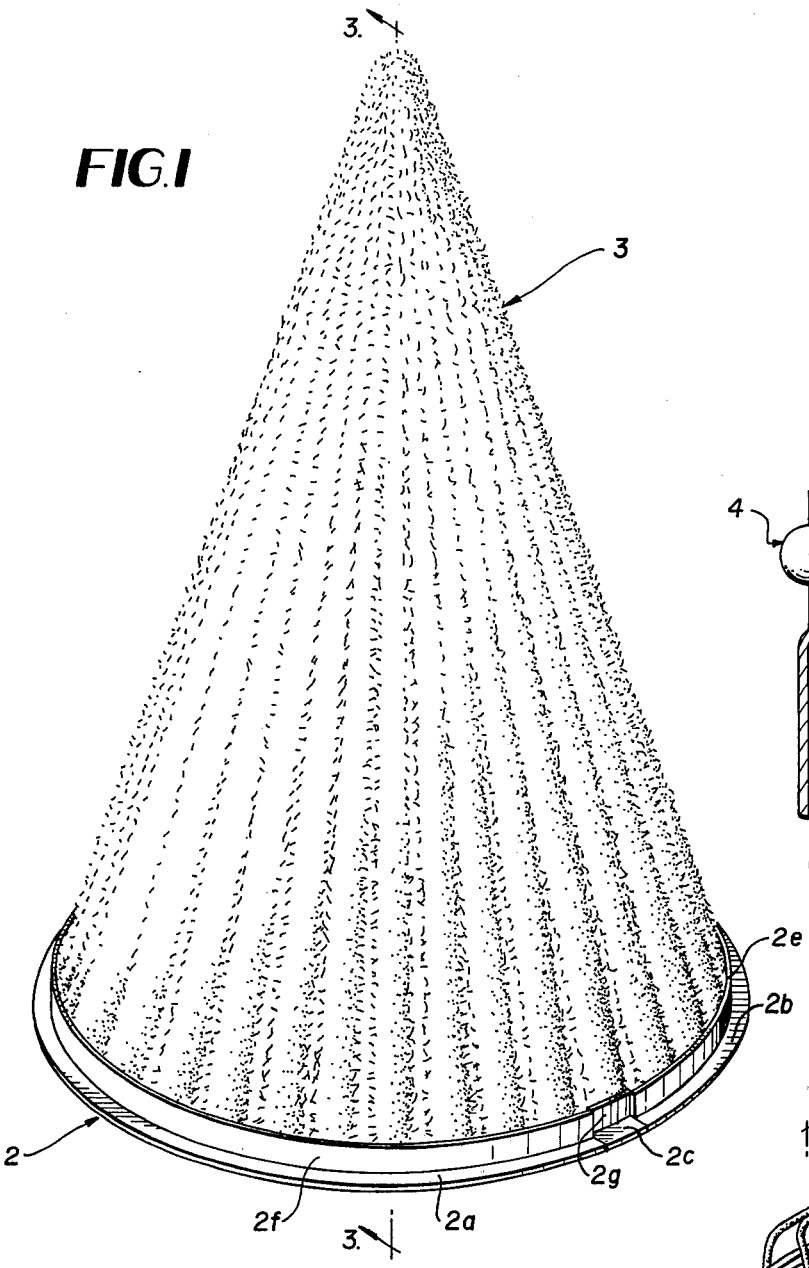
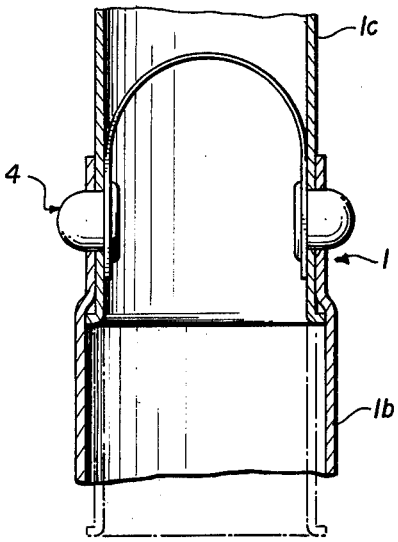
FIG. 7
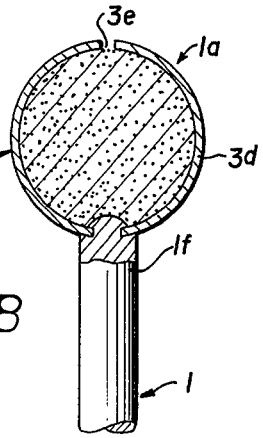
FIG. 8
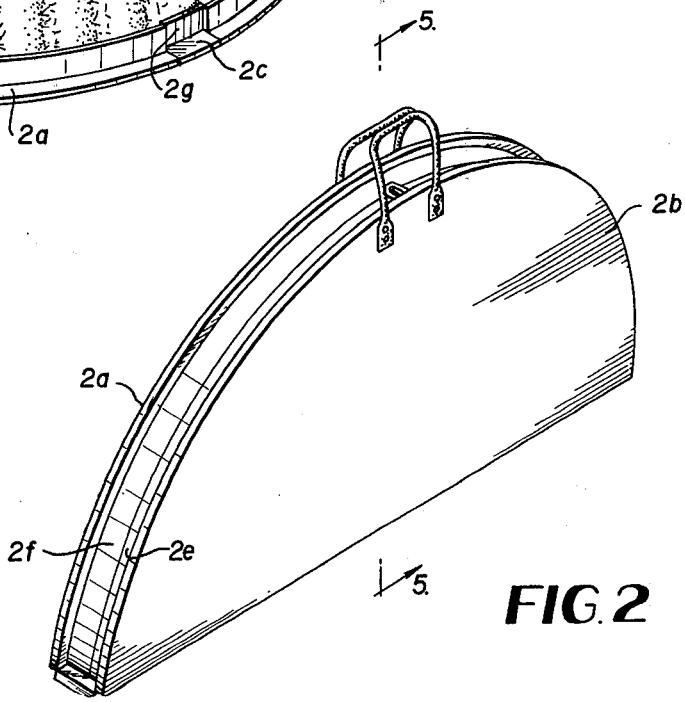
FIG. 2

FIG. 3
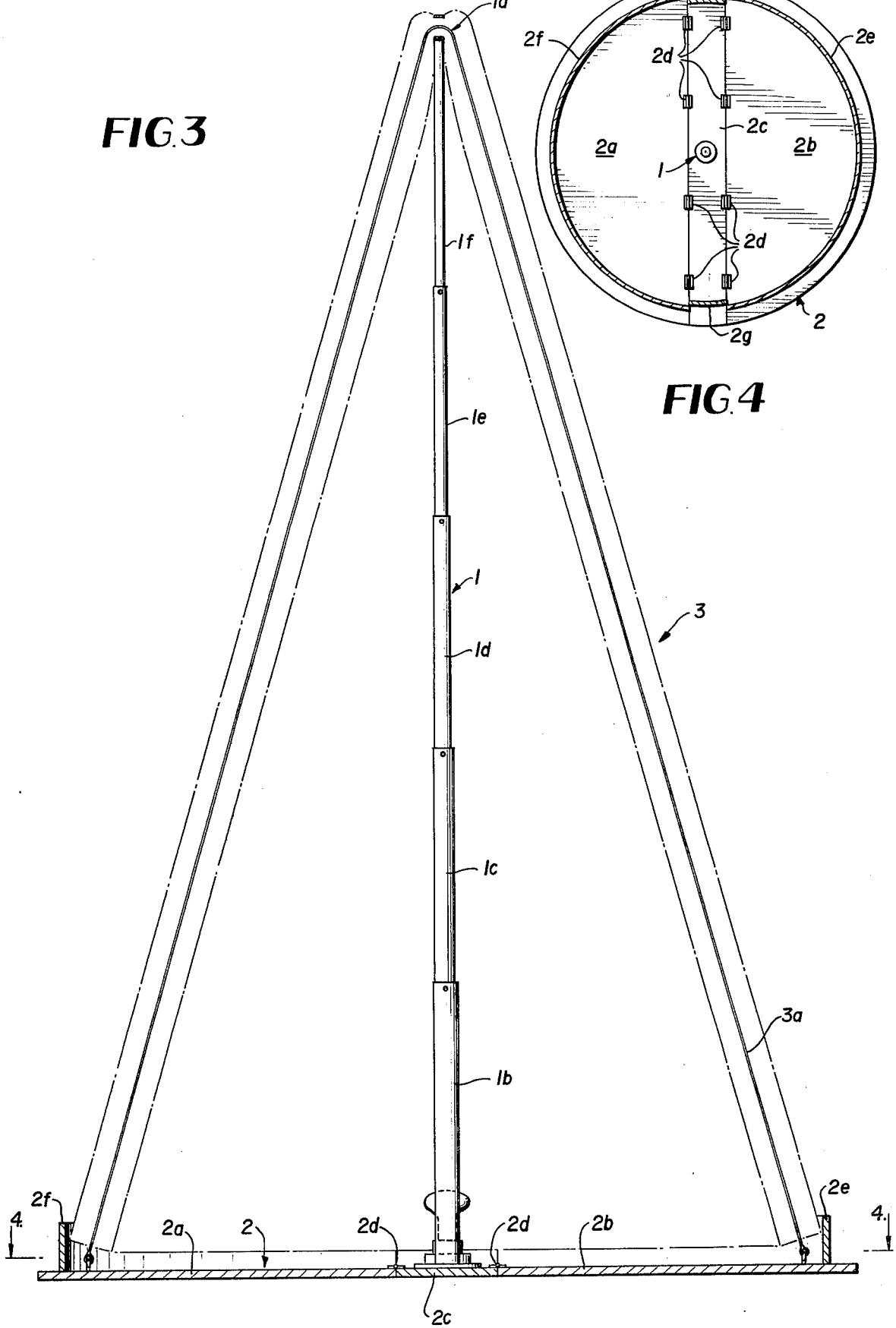
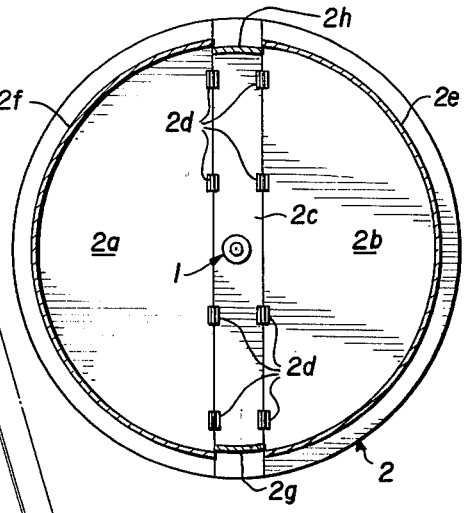
FIG. 4

COLLAPSIBLE ARTIFICIAL CHRISTMAS TREE

BACKGROUND OF THE INVENTION

Heretofore, various collapsible artificial Christmas trees have been proposed, and while they have been satisfactory for their intended purpose, they have required considerable time and effort not only in the erection of the tree but also in the dismantling and storage thereof.

To overcome the disadvantages characterized by prior artificial Christmas trees, the collapsible artificial Christmas tree of the present invention has been devised which comprises, essentially, a plurality of telescopic tubular members adapted to form a mast when extended, the lower end of the mast being mounted on a base, and garland extending between the base and the top of the mast to form a generally conically-shaped configuration. The base includes a plurality of hingedly connected sections adapted to be folded to form a carrying case for storing the telescoped tubular members and associated garland when the tree components are in the collapsed position.

BRIEF DESCRIPTION OF THE DRAWINGS

FIG. 1 is a perspective view of the artificial Christmas tree of the present invention in the erected position;

FIG. 2 is a perspective view of the base of the tree folded to form a carrying case for the tree in the collapsed position;

FIG. 3 is a view taken along line 3—3 of FIG. 1;

FIG. 4 is a view taken along line 4—4 of FIG. 3;

FIG. 7 is an enlarged, fragmentary view, partly in section, illustrating the detent assembly for holding the tubular sections in the extended position;

FIG. 8 is an enlarged, fragmentary view, partly in section, showing the top of the mast with the garland extending therethrough;

DESCRIPTION OF THE PREFERRED EMBODIMENT

Figure 9:
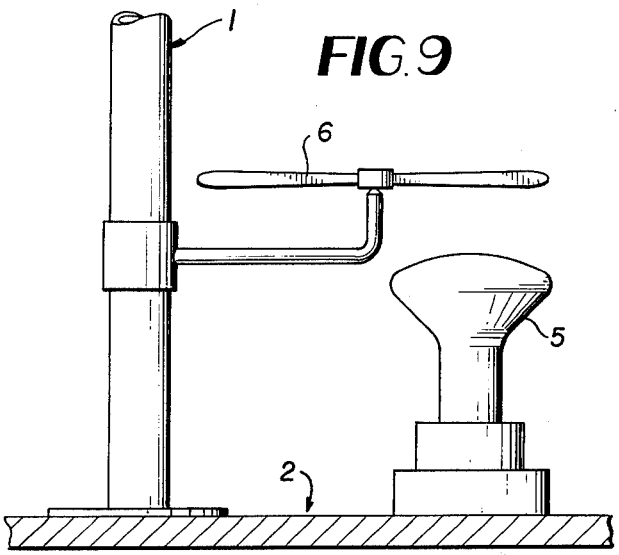
FIG. 9 is a fragmentary, side elevational view showing a light mounted on the base and a light-filter-type mobile mounted on the mast.

Referring to the drawings and more particularly to FIGS. 1 and 3 thereof, the collapsible artificial Christmas tree of the present invention comprises a telescopic mast 1 mounted on a base 2, and having garland 3 extending between the base 2 and the top 1*a* of the mast 1, to thereby form a generally conically-shaped configuration when in the erected position.

Figure 5:
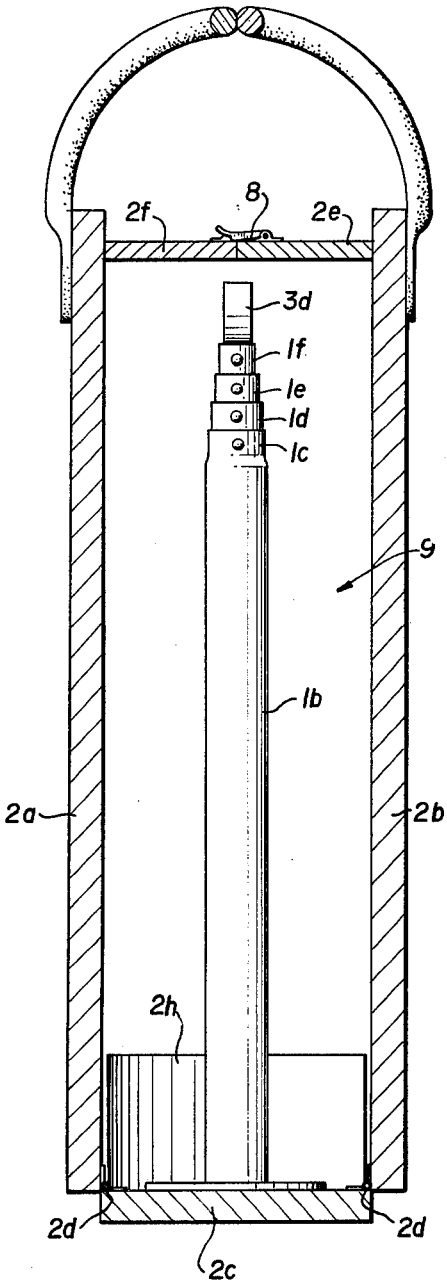
FIG. 5 is a view taken along line 5—5 of FIG. 2.

The mast 1 consists of a plurality of telescopic tubular members 1*b*, 1*c*, 1*d*, 1*e* and 1*f*. While for purposes of illustration five tubular members are shown, it will be understood that any number of tubular members may be employed depending upon the size of the tree desired. The tubular members are held in the extended position by suitable spring biased detents 4, as shown in FIG. 7. By this construction and arrangement, the mast 1 can be held in the extended or erected position as shown in FIGS. 1 and 3, or can be moved to the collapsed position wherein adjacent tubular members are telescoped within each other as shown in FIG. 5.

As will be seen in FIGS. 3 and 4, the base 2 comprises a pair of semi-circular panel members 2*a*, 2*b* having their diametrical edges connected to corresponding edges of an intermediate member 2*c* by means of a plurality of hinges 2*d*. Each of the semi-circular members 2*a*, 2*b* is provided with a circular wall or gallery 2*e*, 2*f* in proximity to the circumferential edge thereof, and the intermediate member 2*c* is similarly provided with arcuate wall members 2*g* and 2*h* at each end portion thereof but spaced slightly radially inwardly of the wall portions 2*e*, 2*f* as shown in FIG. 4.

Referring to FIGS. 1, 3, 6 and 8, the garland 3 comprises a plurality of wire or cable strands 3*a* having tinsel 3*t* or other suitable reflective material connected thereto. The ends of each of the wires 3*a* are connected to the base by a snap fastener 3*b* extending through an eyelet 3*c* secured to the base. The portion of each garland strand intermediate the ends thereof is received within a ring 3*d* secured to the top of the mast as shown in FIG. 8, the ring being split as at 3*e* to facilitate the insertion of the garland strands therein.

Figure 10:
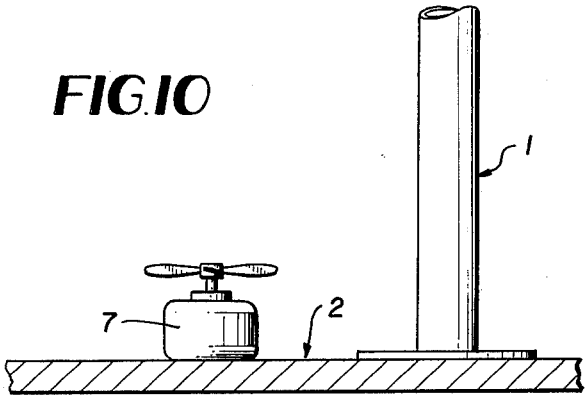
FIG. 10 is a fragmentary, side elevational view showing a fan mounted on the base.
Figure 6:
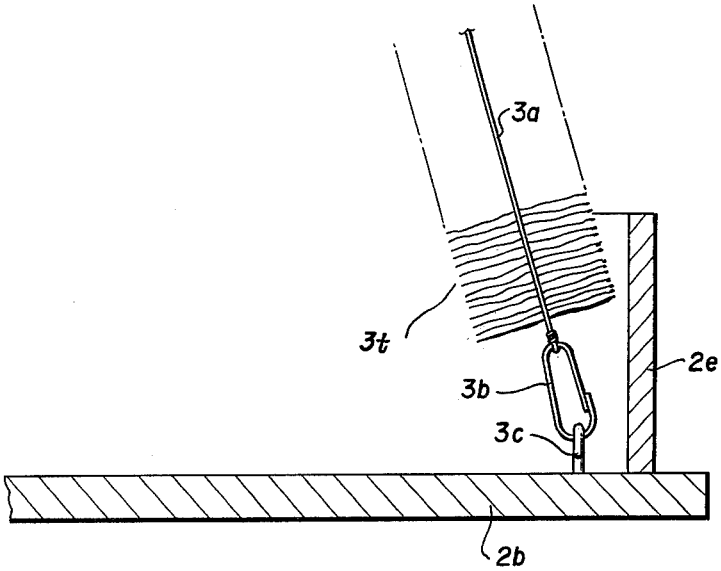
FIG. 6 is an enlarged, fragmentary view, partly in section, showing the connection of the garland to the base.

To enhance the decorative effect of the tree, a lamp 5 is mounted on the base as shown in FIG. 9 and a light filter mobile 6 is mounted on the lower end of the mast; additionally, a fan 7 is mounted on the base as shown in FIG. 10.

To collapse the Christmas tree from the erected position as shown in FIG. 1 to the stored position as shown in FIG. 5, the spring-biased detents 4 are pressed inwardly to the released position to allow the tubular members to move to the telescoped position as shown in FIG. 5. The semi-circular members 2*a*, 2*b* of the base are pivoted upwardly from the horizontal position to the vertical position and the arcuate wall members 2*e*, 2*f* are connected by a suitable latch 8, to thereby form a storage compartment 9. To facilitate carrying the collapsed assembly, handles 10 are attached to each of the semi-circular members 2*a*, 2*b*. While for sake of clarity, the garland 3 is not shown in FIG. 5, it will be understood by those skilled in the art that by suitably dimensioning the base, the garland may remain connected to the mast and base and the various decorative components such as light, fan, etc. can be wholly contained within the compartment 9 so that when erecting the Christmas tree, it will only be necessary to release latch 8, fold the members 2*a*, 2*b* downwardly to the horizontal position, and then pull the tubular sections upwardly to form the mast 1.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A collapsible artificial Christmas tree comprising, a base, one end of a telescopic mast being connected to said base, garland means extending between the base and the opposite end of the mast to form a generally conically-shaped configuration; said base comprising a plurality of panel members, and hinge means interconnecting said panel members, whereby in the erected position the panel members are disposed in a substantially horizontal plane to support the tree, and in the collapsed position certain panel members are foldable to a substantially vertical plane to thereby form a storage compartment for the collapsed tree, and wall means connected to said panel members in proximity to the edges thereof to thereby provide a gallery for the base when in the erected position, and a wall of the storage compartment when the panels are in the folded position.

2. A collapsible artificial Christmas tree according to claim 1, wherein the mast comprises a plurality of telescopic tubular members, and detent means releasably connected to said tubular members, whereby the tubular members can be selectively held in an extended position to form the mast, and released to the telescoped collapsed position.

3. A collapsible artificial Christmas tree according to claim 1, wherein, the panel members comprise, a pair of spaced panel members, an intermediate panel member disposed in the space between said pair of panel members, said intermediate panel member having opposite edges extending parallel to and adjacent corresponding edges of said pair of panels, said hinge means connecting said pair of panel members to said intermediate member, and said one end of said mast being connected to said intermediate panel member.

4. A collapsible artificial Christmas tree according to claim 3, wherein said pair of panel members are semi-circular with their diametrical edges being disposed adjacent the edges of said intermediate panel member, and said wall means comprising a semi-circular wall connected to each semi-circular panel in proximity to the circumferential edge thereof.

5. A collapsible artificial Christmas tree according to claim 4, wherein arcuate wall members are mounted on each end of said intermediate panel member, said arcuate wall members being positioned radially inwardly with respect to said semi-circular walls.

6. A collapsible artificial Christmas tree according to claim 4, wherein latch means are connected to said semi-circular walls for holding the edges thereof in abutting relationship when the panels are in the folded position.

7. A collapsible artificial Christmas tree according to claim 6, wherein handle means are connected to said semi-circular panel members to facilitate the carrying thereof while in the folded position.

8. A collapsible artificial Christmas tree according to claim 1, wherein said garland means comprises, a plurality of strands having reflective material connected thereto, the ends of each strand being connected to said base, the portion of each strand intermediate the ends thereof being connected to the top of said mast.

9. A collapsible artificial Christmas tree according to claim 8, wherein a ring is mounted on the top of said mast, the intermediate portion of each strand extending through said ring.

* * * * *